US006886706B2

(12) United States Patent
Bakker

(10) Patent No.: US 6,886,706 B2
(45) Date of Patent: May 3, 2005

(54) CONTAINER CLOSURE SEAL

(76) Inventor: Renee Bakker, c/o American Flange 290 E. Fullerton Ave., Carol Stream, IL (US) 60188

( * ) Notice: Subject to any disclaimer, the term of this patent is extended or adjusted under 35 U.S.C. 154(b) by 519 days.

(21) Appl. No.: 09/920,092

(22) Filed: Aug. 2, 2001

(65) Prior Publication Data

US 2001/0053316 A1 Dec. 20, 2001

(30) Foreign Application Priority Data

Feb. 2, 1999 (EP) ..... 99300769

(51) Int. Cl.[7] ..... B65D 51/18
(52) U.S. Cl. ..... 220/200; 220/254.8; 220/288
(58) Field of Search ..... 220/601, 238, 220/256.1, 254, 200; 277/944, 936, 607, 650, 627, 634

(56) References Cited

U.S. PATENT DOCUMENTS

| | | | | |
|---|---|---|---|---|
| 1,952,036 | A | * | 3/1934 | Dillhoefer |
| 3,208,775 | A | | 9/1965 | Stap |
| 3,946,894 | A | | 3/1976 | Simkus |
| 4,480,843 | A | * | 11/1984 | Springer |
| 4,706,836 | A | | 11/1987 | Greck |
| 5,028,056 | A | * | 7/1991 | Bemis |
| 5,197,768 | A | * | 3/1993 | Conner |
| 5,297,824 | A | * | 3/1994 | Imhof |
| 5,695,201 | A | * | 12/1997 | Wheeler |
| 5,853,100 | A | * | 12/1998 | Kars |
| 6,337,374 | B1 | * | 1/2002 | Ngoc |

FOREIGN PATENT DOCUMENTS

| | | |
|---|---|---|
| FR | 2520467 | 7/1983 |
| FR | 2755723 | 5/1998 |
| GB | 1392603 | 4/1975 |

* cited by examiner

*Primary Examiner*—Flemming Saether

(57) ABSTRACT

Disclosed herein is a container closure sealing washer pre-assembly (40) comprising at least one part (42) of one material integrally formed with another part (44) of another material, preferably both materials are resiliently deformable, elastomers, with said one material being capable of greater compression than said another material and being a nitrile rubber and said another material being more inert to or compatible with given container contents than said one material and being an ethylene-propylene-diene-monomer rubber; the sealing washer may be used in combination with an insert (10) having a body (12) with a radially extending flange (14), the sealing washer being stretched about and thereby retained on the flanged insert and assuming a cylindrical to frusto-conic shape with at least said one part tightly in contact with the insert body and the said another part proximate to or contacting the insert flange; and the combination may be included in a closure for a container (22) with the flanged insert located in a collar (18) extending outwardly from the container, said one part of the sealing washer being radially compressed between the insert body and the collar and said another washer part being wedged between the corner formed by insert body and the insert flange and the corner formed by the container wall and the collar.

3 Claims, 4 Drawing Sheets

CONTAINER CLOSURE SEAL

This application is a continuation of International Application No. PCT/GB/00184 filed Jan. 24, 2000 which designates the U.S.

BACKGROUND OF THE INVENTION

This invention relates to container closures and it particularly relates to sealing washer pre-assemblies for container closure systems.

One application of the present invention is known as a polygonal base flange closure system. The components of an exemplary prior art container closure system of this type are shown in exploded, perspective view by FIG. 1 to comprise an insert 10, generally of coated mild steel, having an internally threaded, tubular body 12 with a radially outwardly extending flange 14; the flange having an polygonally shaped periphery 16. The insert fits into a collar 18 formed in a wall 20 of a metal, such as mild steel, container 22 and the container wall 23 around the collar has a complimentary shape to the flange periphery, to prevent the insert from turning in the collar. An elastomeric flange sealing washer 24 fits about the insert body 12 on the insert flange 14 and is trapped and compressed to seal between the insert and the container wall, when the upper part 26 of the insert has been curled over the collar rim 28. An externally threaded plug 34, with an elastomeric plug washer 36 is screwed into the insert body to seal and close the container. The whole closure may be closed by an anti-tamper cap 38 crimped over the insert curled upper part 26.

The elastomeric flange sealing washers 24 of such type A closure systems are prone to leak when a filled container is dropped, especially when the dropped container lands on the closure; the insert 10 being forced inwards relative to the container wall 20, which decompresses the flange sealing washer 24. In drop tests in accordance with paragraph 9 of The United Nations "Recommendations on the Transport of Dangerous Goods", container closures of the above described type tend to fail when the container is dropped from heights of 2 meters or lower and the closure is positioned during the drop test such that the drop impact fold line in the container wall (e.g. drum top) runs across the closure.

A solution to this problem is described in Document U.S. Pat. No. 5,853,100 (Kars), wherein an additional flange sealing washer is radially compressed between the insert and the collar, the additional flange sealing washer being of a resiliently deformable elastomeric material that, when compressed, has a lower coefficient of friction with regard to the coated or uncoated mild steels of the insert and collar than other types of flange sealing washer materials, such as white EPDM rubber. These material characteristics of the additional flange sealing washer enables it both to be positioned and compressed in the correct position between the collar and the insert and to remain compressed and in position in the event that the insert is forced inwards relative to the container wall; thereby maintaining an effective seal between the insert and the collar. When subjected to the same UN drop test there were no failures for container closures fitted with the above described additional flange sealing washer.

In spite of its technical superiority over conventional container closures there are major problems with the use of this additional flange sealing washer, mainly because of quality control and efficiency in the automatic assembly of flange sealing washers with inserts. Inserts fitted with two flange sealing washers are produced and sold as a combination, together with other components, to container manufacturers who form the collars and fit the closures to the containers; using purpose-designed closure insertion tools.

Document U.S. Pat. No. 3,208,775 (Stap et al) discloses a closure seal with an "additional protecting ring 15 made of a compressible or deformable material having a high resistance to aggressive fluids, solvents, detergents and the like, such, for example as polyethylene or other suitable thermoplastic materials" (column 2, lines 43 to 46). Document U.S. Pat. No. 3,946,894 (Simkus) discloses a "resilient sealing gasket 18" (column 2, line 47). Document GB 1 392 603 A (Drums Ltd.) discloses "Sealing gaskets, an 'O' ring 4 and a plain cylindrical ring 5, both of rubber" (see page 2, lines 9 and 10). Document FR 2 755 723 A (Phoenix France) discloses a coextrusion of a base EPDM and a mixture of polyvinyl chloride and nitrile butadiene to form a sliding facing 20 on a glass mounting joint. Document FR 2 520 467 A (Comnind Spa Azienda Ages) discloses a rubber vehicle window seal 10 co-extruded with a foam rubber sealing flange 20.

The system by which a flange sealing washer is typically fitted to a flanged insert on the assembly lines of a closure manufacturer comprises conveying each insert sequentially past two washer loading stations, which can each deliver a washer to and fit and stretch it over the tubular body of an insert so that the washer lies in contact with the insert flange. The second washer delivery station is provided to guard against miss-feeds, being arranged to fit a washer to an insert in the event that the first station fails. For closures in accordance with our above International Patent Specification, the second washer delivery station is employed to fit the additional washer. As this additional (second) washer differs in configuration and material to the original washer, each delivery station has to meet different assembly parameters resulting in a non-interchangeability of parts and equipment and some assembly failures; as inserts can come off the assembly line without one or the other or both washers. With this additional requirement of different washer assembly operations, the manufacturing efficiency of closures in accordance with Document U.S. Pat. No. 5,853,100 (Kars) tends to be reduced.

For an additional washer, an intensified quality control system is required to assure that the additional washer is always present and at its design position.

A solution to this assembly problem would be the use of a single flange sealing washer having the necessary compressibility/friction characteristics and indeed such a single flange sealing washer is described in Document U.S. Pat. No. 5,853,100 (Kars), but this single flange sealing washer has a complex cross-section, it is L-shaped, and has to combine the high compressibility and low co-efficient of friction characteristics in the one material. The cross-sectional shape is more expensive to produce and more complicated to assemble automatically. Also, being of a single material, such flange sealing washers are generally not universally compatible with all container contents and thus limit the use of the container to which they are fitted. From a logistics point of view it is much preferable to have a nearly universally useable flange sealing washer and a consequentially nearly universally useable container.

The elastomeric plug washers 36 do not normally leak in such UN drop tests. However, the elastomer of which the plug washer is made has to be related to container contents; an elastomer/content combination that causes the elastomer to swell is unacceptable as this would prevent a plug from being properly refitted. Thus, conventional prior art plug washers have, for example, used black nitrile rubber for mineral oil contents and EPDM for chlorinated hydrocarbons, foodstuffs etc.

A major problem with the plug washer in another application known as a serrated base flange closure system is that, due to its design of a large, flat, unenclosed washer, a much higher closing torque is required than for the polygonal system plug washers; 50% or more. Expensive elastomers such as VITON® are required to cope with container contents and torque loads. Costs are further increased because of the larger cross-sectional size of serrated system plug washers.

SUMMARY OF THE INVENTION

According to the present invention, a container closure sealing washer is a pre-assembly having at least one part of one material integrally formed with another part of another material. None of the above-referred documents discloses such a closure sealing washer pre-assembly.

A sealing washer pre-assembly in accordance with the present invention overcomes the above-stated assembly problems of polygonal base flange sealing washers because the second washer delivery station can be the same as the first station and, as such, be used as a back-up; increasing production efficiency from perhaps 80% to 95%. Also, sealing washer pre-assemblies in accordance with the present invention can be fitted to inserts on single washer delivery station assembly lines. With such an integral flange sealing washer, the risk of one part of the sealing combination being missed from an assembly is no longer relevant and the quality control and related product liability risks can be greatly reduced.

According to one embodiment of the present invention, both materials are of resiliently deformable, elastomers; said one material being capable of greater compression than said another material.

According to another embodiment of the present invention, said another material is more inert to or compatible with given container contents than said one material. Said one material may be nitrile rubber and said another material may be selected from the group comprising copolymers of Ethylene-Propylene-Diene Monomer rubbers.

One method of producing a sealing washer pre-assembly in accordance with the present invention comprises the steps of co-extruding a tube of said another material about a tube of said one material so that the two materials bond to one another as an integral whole and then laterally slicing the thus formed dual material tube into dual material sealing washer pre-assemblies. Coextrusion of tubes is well-known; for example see RAPRA Review Report 62"Coextrusion" Volume 6, Number 2, 1992 (ISSN: 0889-3144) page 3, column 2, $4^{th}$ paragraph.

Another method of producing an integral sealing washer pre-assembly in accordance with the present invention comprises the steps of separately extruding tubes of said one material and said another material, the tube of said another material being sized to nest co-axially about the tube of said one material, co-axially nesting one tube about the other, bonding the materials of the two tubes together and then laterally slicing the thus formed dual material tube into integral sealing washer pre-assemblies. International Patent Specification No. WO 96/09483 discloses gasket rings cut from a tubular sealing member having a tubular carrier and an outer coating of gel, see FIG. 12 and page 18, $3^{rd}$ paragraph.

Further methods of producing integral sealing washer pre-assemblies in accordance with the present invention include injecting two different materials into a suitable mould and bonding the two materials together as part of the injection moulding process or punching blanks from bonded sheets of different materials and then slug moulding the blanks.

According to a further embodiment of the present invention the sealing washer pre-assembly is a plug sealing washer with the major part of said one material and a container contents facing end part of said another material.

A sealing washer pre-assembly in accordance with the present invention enables serrated system plug washers to be made with a container facing end part of content compatible material with the remainder of the washer of material suitable for sealing at lower torques; this both overcomes the problem of closing at relatively high torques and reduces material costs.

A polygonal base flange sealing washer pre-assembly in accordance with the present invention may be used in combination with an insert having a radially extending flange, the combination being characterised in that the flange sealing washer is stretched about and thereby retained on the insert and the flange washer assumes a cylindrical to frusto-conic shape with at least said one part tightly in contact with the insert body and the said another part proximate to or contacting the insert flange. Preferably, the flange sealing washer is positioned on the insert with said one part uppermost on the insert body.

Further according to the present invention, a container with a container closure and a flange sealing washer and flanged insert combination, the insert is located in a collar extending outwardly from the container, said one part of the flange sealing washer is radially compressed between the insert body and the collar and said another washer part is wedged between the corner formed by the insert body and the insert flange and the corner formed by the container wall and the collar.

The shaping of the flange sealing washer on the insert has proved ideal for subsequent assembly of the container closure as it ensures that the high compressibility/low friction material part of the flange sealing washer is compressed and located in the correct position between the insert and the collar whilst the content compatible part of the flange sealing washer is trapped in its protecting position between the container wall and the flange.

We believe that the above described shaping is primarily dependant on the dimensions of the flange sealing washer and the insert body; although physical characteristics of the flange sealing washer materials, such as tensile strength, stress at elongation and hardness may also be relevant.

BRIEF DESCRIPTION OF THE DRAWINGS

The above and other features of the present invention are illustrated in the Drawings, wherein.

DETAILED DESCRIPTION

Figure 1:
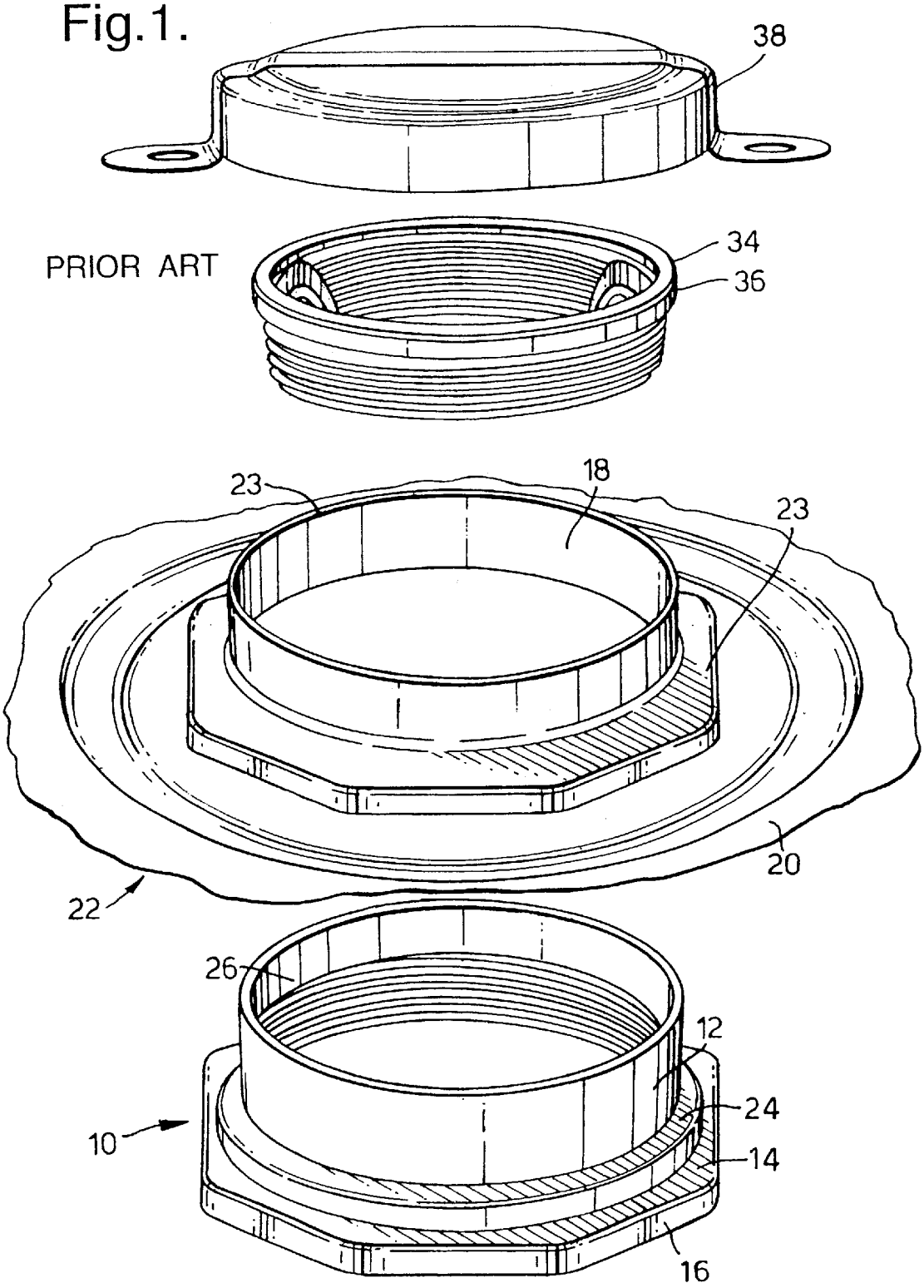
FIG. 1 is an exploded perspective view of a prior art polygonal base flange closure system.
Figure 2:
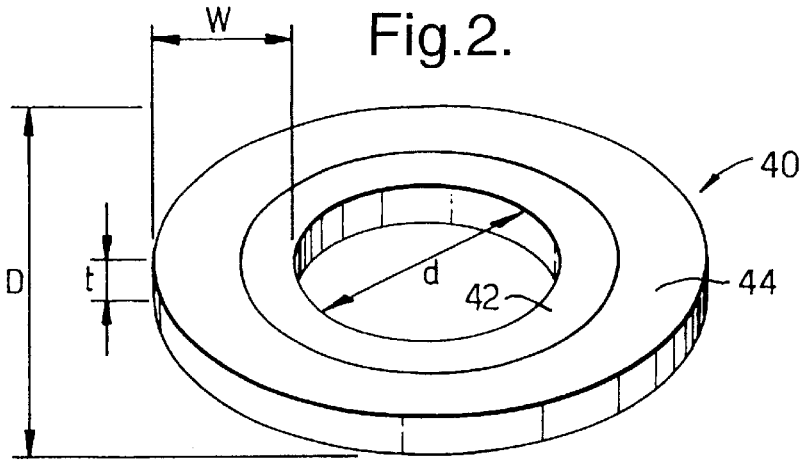
FIG. 2 is a perspective view of a dual material, container closure flange sealing washer pre-assembly in accordance with one embodiment of the present invention.

As shown by FIG. 2, an integral flange sealing washer pre-assembly 40 in accordance with the present invention and for a polygonal base flange closure system is a flat annulus having an inner annular part 42 of a highly compressible, resiliently deformable elastomeric material; such as a black nitrile rubber (being a copolymer of butadiene and acronitrile). The flange sealing washer has an outer annular part 44 co-axially nested about the inner annular part 42 and of a container-content-compatible, elastomeric material, such as white EPDM rubber (a copolymer of Ethylene-Propylene-Diene-Monomers). The outer annular part 44 is bonded or otherwise made integral with the inner annular part 42. Black nitrile rubbers have a lower coefficient of friction at high compression in relation to the mild steels forming a closure insert and container collar than white EPDM rubbers.

In an exemplary flange sealing washer pre-assembly for a 2" (G2) closure flange

Dimensions are:

Outer Diameter (D) of 63 mm

Inner Diameter (d) of 45 mm

Ratio of outer to inner diameters (D:d) approximately 1.4:1

Intermediate diameter (I) of 51 mm

Ratio of intermediate to inner diameters (I:d) approximately 1.1:1

Thickness (t) of 1.6 mm

Ratio of width to thickness (W:t) approximately 5.6:1.

Material characteristics are:

Black Nitrile rubber outer part

Tensile strength >6.9 $MN/m^2$

Stress at 125% elongation >4.4 $MN/m^2$

Hardness Shore "A" >60

White EPDM rubber inner part

Tensile strength >5.9 $MN/m^2$

Stress at 150% elongation >4.0 $MN/m^2$

Hardness Shore "A" >60.

One method of producing a flange sealing washer pre-assembly in accordance with the present invention is to co-extrude or otherwise assemble tubes of the inner and outer materials, so that the two tube materials are bonded one to the other, and then laterally slicing the thus formed dual material tube into annular flange sealing washers of regular, rectangular cross-section.

Figure 3A:
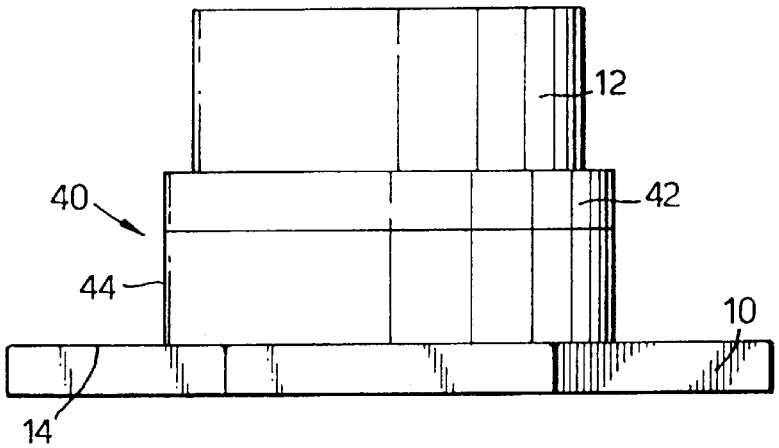
FIG. 3*a* is an elevation showing the flange sealing washer of FIG. 2 assembled with a flanged insert and assuming a cylindrical shape.
Figure 3B:
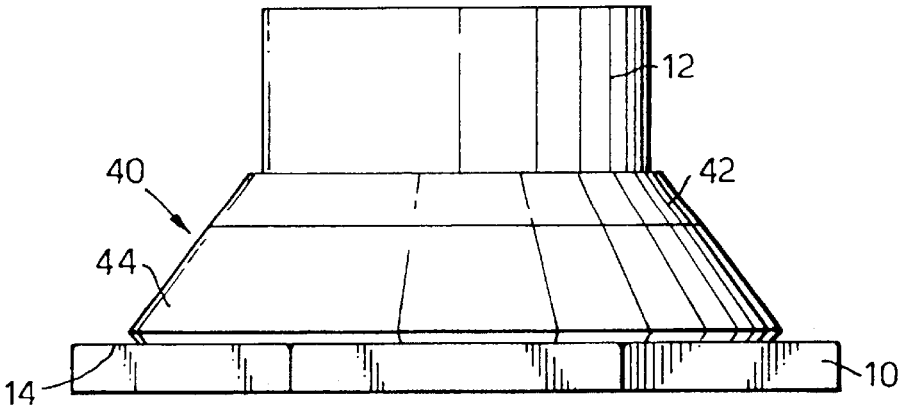
FIG. 3*b* is a similar elevation to that of FIG. 3*a*, but wherein the flange sealing washer assumes a frusto-conic shape.

Assembled flange sealing washer and flanged insert combinations are shown in FIGS. 3*a* and 3*b*. We have discovered that, on assembly of a flange sealing washer 40 in accordance with the present invention with a standard flanged insert 10, the washer, when stretched onto the insert tubular body 12, assumes a shape that can vary between cylindrical (FIG. 3*a*) and frusto-conical (FIG. 3*b*); in either case with the end portion of inner part 42 in tight contact with the insert tubular body 12, such that the flange sealing washer is retained on the insert, and with the end portion of the outer part 44 either proximate to or in contact with the insert flange 14.

Figure 4:
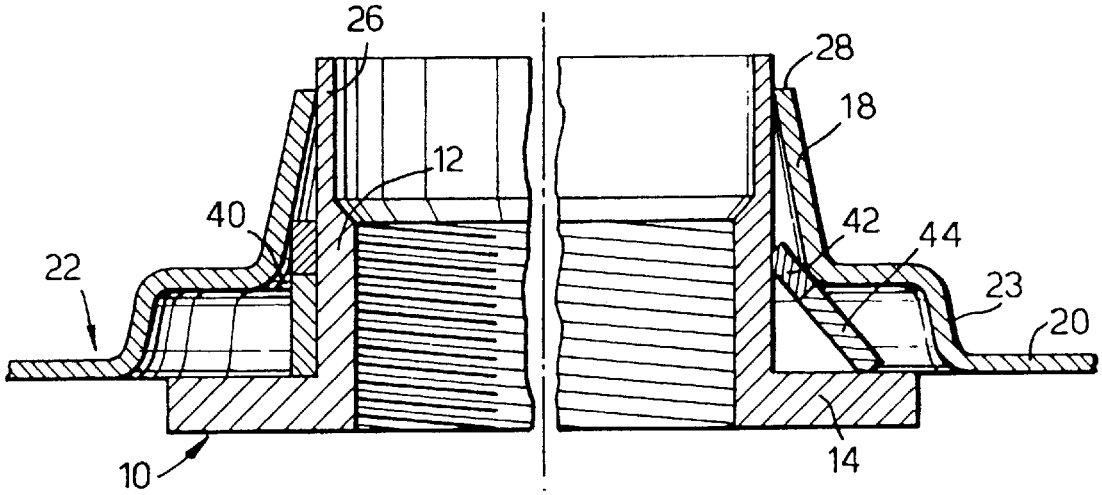
FIG. 4 is a sectional elevation showing, in left and right-hand cross-sections, the assembled flanged inserts of FIGS. 3*a* and 3*b* respectively, positioned in a container prior to final assembly.
Figure 5:
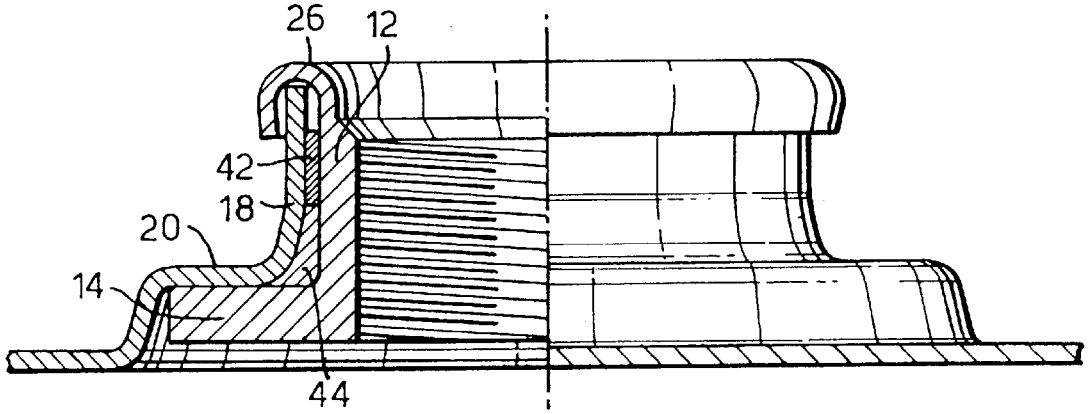
FIG. 5 is a part cross-sectional elevation of the flange sealing washer and flanged insert combinations of FIGS. 3*a* and 3*b* after final assembly.

This cylindrical to frusto-conical shaping is an unexpected result of the assembly of the flange sealing washer with the insert and has the benefit in that it places the flange sealing washer in the ideal position for subsequent mounting of the closure to a container; this is illustrated in FIGS. 4 and 5. The curling operation of the insert upper part 26 over the collar rim 28 forces the insert 10 closely into the collar 18 so that the flange sealing washer inner part 42 is radially compressed between the collar 18 and the insert tubular body 12 and the washer outer part 44 wedged between the corner formed by the insert body 12 and flange 14 and corner formed by the collar 18 and container wall 20.

Figure 6:
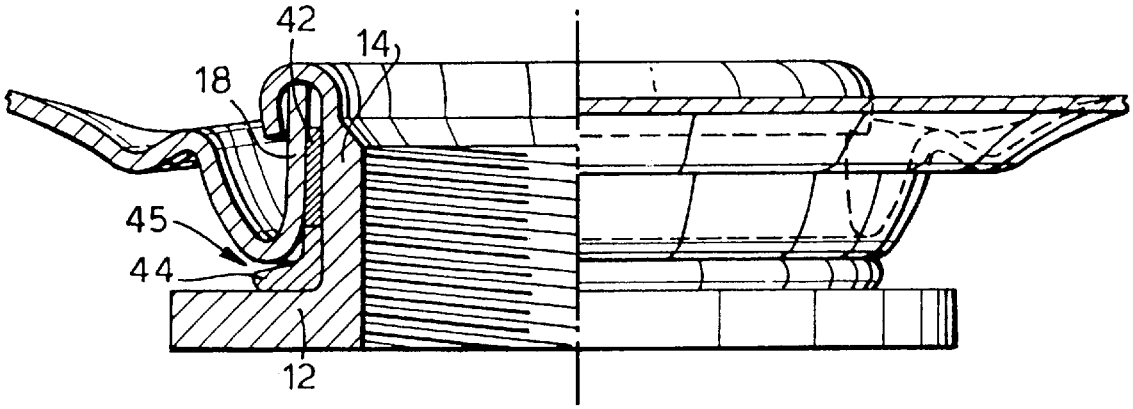
FIG. 6 is a similar elevation to that of FIG. 5, after a drop test.

The inner part 42 of flange sealing washer 40 is equivalent to the additional flange sealing washer described in Document U.S. Pat No. 5,853,100 (Kars), and fulfils the same function of maintaining the seal between the insert 10 and the container collar 18 in the event that the container closure is damaged by the insert being forced into the container relative to the collar, as shown by FIG. 6. The inner washer part 42, being of the highly compressible, resiliently deformable, black nitrile rubber, remains in position because of its low friction characteristics and remains sufficiently compressed between the insert body 12 and the collar 18 to maintain a seal because of its original high compression whilst the outer part 44 is decompressed to the extent that there is a gap 45 (exaggerated for purposes of illustration) between the outer part 44 and the container wall 20, such that this part no longer seals.

Direct contact between either the collar or the container wall and the insert is immaterial in that the container closure seal depends upon radial compression of the flange sealing washer between the insert and the collar and the design of the closure is such that correct positioning and compression of the flange sealing washer will occur and prevent the facing surfaces of the insert and container wall from normally directly contacting one another.

Container closures incorporating a dual material flange sealing washer pre-assembly in accordance with the present invention have all the advantages of the container closure described in Document U.S. Pat No. 5,853,100 (Kars), together with the additional advantages of a more consistent flange sealing washer to flanged insert assembly and improved quality control and manufacturing efficiency obtained by the regular rectangular cross-sectional shape of the flange sealing washer. Another important advantage is that container closures incorporating a dual material flange sealing washer in accordance with the present invention can be fitted to containers using existing closure insertion tools as designed for the container closure described in Document U.S. Pat No. 5,853,100 (Kars).

Figure 7:
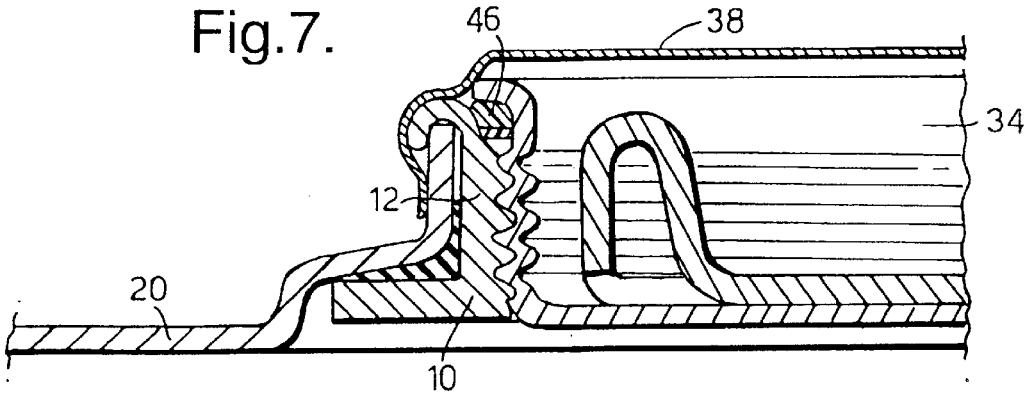
FIG. 7 is a sectional elevation of part of a closure with a plug and plug sealing washer in accordance with a second embodiment of the present invention.
Figure 8:
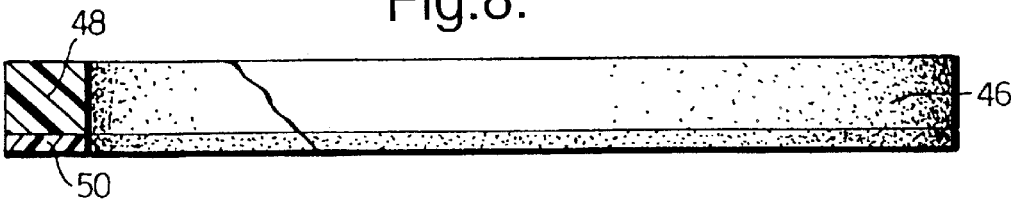
FIG. 8 is a sectional elevation of a plug sealing washer for the plug of FIG. 7.

FIGS. 7 and 8 show with a plug 34 for use with the polygonal base flange closure systems of FIGS. 3 to 6 and having a plug sealing washer pre-assembly 46 in accordance with a second embodiment of the present invention. The plug closes the threaded neck 12 of the closure insert 10 in the container 20 and the plug washer seals the insert. In this embodiment, the plug sealing washer is of generally cylindrical section with an axially outer part 48 of low coefficient of friction black nitrile rubber and an integral, axially thin, inner part 50 of white EPDM rubber. The upper part 48 is of low friction rubber and is highly compressible to maintain a seal. The lower part 50 EPDM rubber that is effectively inert for all container contents. This dual material plug sealing washer replaces the usual EPDM rubber plug sealing washer.

Another method of manufacturing integral sealing washers in accordance with the present invention is to extrude and then nest and bond tubes of black nitrile rubber and white EPDM rubber, transversely cut the co-axial tubes to the required thickness and then stretch the dual material washer into the right configuration on the plug. Whilst this plug sealing washer is more complex to manufacture than a conventional single material plug sealing washer, it has the advantages of being composed mainly of black nitrile rubber which offers better sealing characteristics than and is considerably cheaper than white EPDM rubber or VITON®. The relatively low coefficient of friction of the black nitrile rubber helps the whole plug washer to slide between the plug and the insert so that it can be highly compressed therebetween; this reduces distortion of the sealing washer and establishes a better seal.

Figure 9:
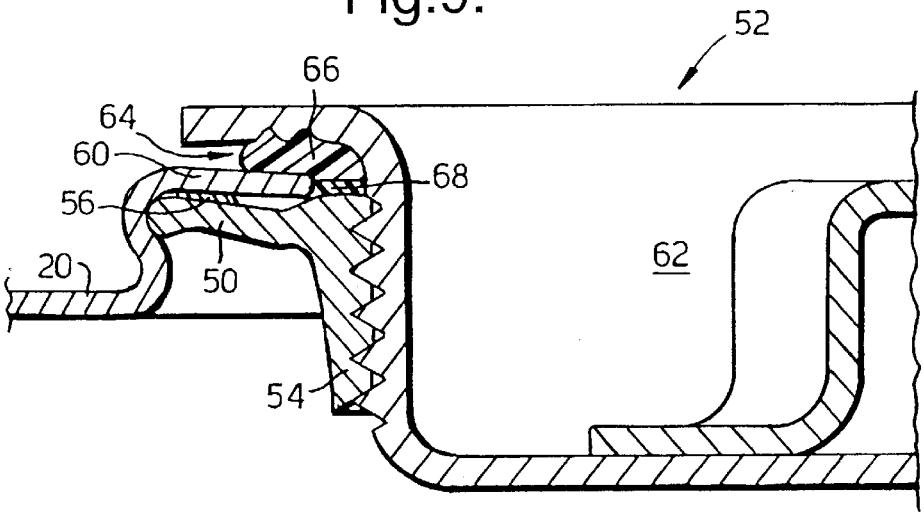
FIG. 9 is a sectional elevation of a plug and plug sealing washer in accordance with a third embodiment of the present invention and for an alternative type of drum closure.
Figure 10:
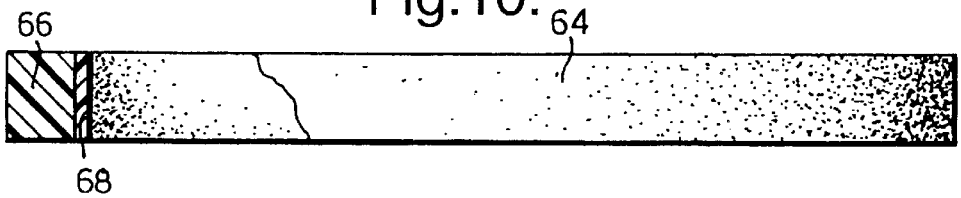
FIG. 10 is a sectional elevation of a plug sealing washer for the plug of FIG. 9.

FIGS. 9 and 10 show a type B container closure 52, wherein a threaded serrated insert 54 is radially crimped into the end wall 20 of a container; a compound gasket 56 is axially compressed between an upper radial flange 58 of the insert 54 and an outer radial flange 60 of the container end wall 20. The insert is closed by a plug 62 and sealed by a plug sealing washer 64 comprising a major, outer part 66 of black nitrile rubber and an integral, minor, inner, part 68 of EPDM or VITON® rubber. The black nitrile rubber of the major part is highly compressible and of low friction; reducing the closing torque required to achieve a seal between the plug and the container and improving the seal and being more economical.

Whilst container closure sealing washers having only two materials have been described, it is clear that the present invention need not be so limited; depending on the design of closure and the intended use of the container.

I claim:

1. A container with a container closure, the closure including a two part sealing washer pre-assembly insert combination, said insert comprising an internally threaded tubular body a radially extending flange surrounding said tubular body forming a corner therebetween, an axially elongated cylindrical sealing washer tightly surrounding said tubular body and resting in close proximity to said flange, said sealing washer having a uniform rectangular vertical cross section with an integrally formed rectangular vertical cross section upper portion and a rectangular vertical cross section lower portion, a container wall directly overlying said flange having an upstanding collar surrounding said sealing washer with the upper end of said insert curled over said collar, means for radially compressing said sealing washer upper upper portion rectangular cross section between the major portion of said container wall collar and said insert tubular body to cause said sealing washer lower portion rectangular cross section to be deformed by wedging within and completely fill the void formed between said corner on said insert and the corner formed between said overlying container wall and said collar.

2. A container with container closure as claim 1, said sealing washer upper portion being formed of one material and said sealing washer lower portion being formed of another material.

3. A container with container closure as in claim 2, said sealing washer upper and lower portions having a different coefficient of fiction.

* * * * *